United States Patent [19]

Lazaro, Jr.

[11] 4,367,852

[45] Jan. 11, 1983

[54] POWERED WIRE SPOOL HOLDING AND POSITIONING APPARATUS

[75] Inventor: Luis J. Lazaro, Jr., Seattle, Wash.

[73] Assignee: The Boeing Company, Seattle, Wash.

[21] Appl. No.: 221,313

[22] Filed: Dec. 29, 1980

[51] Int. Cl.[3] ..... B65H 49/00

[52] U.S. Cl. ..... 242/129.72; 242/131

[58] Field of Search ..... 242/128, 129.5–129.8, 242/156, 76, 130, 130.1, 131

[56] References Cited

U.S. PATENT DOCUMENTS

| | | | |
|---|---|---|---|
| 1,367,685 | 2/1921 | Cohn | 242/128 |
| 2,053,946 | 9/1936 | Donovan et al. | 221/121 |
| 2,245,841 | 6/1941 | Weiss | 312/97.1 |
| 2,612,324 | 9/1952 | Yorburg | 242/80 |
| 2,792,147 | 5/1957 | Stewart | 221/82 |
| 2,796,263 | 6/1957 | Moore | 274/1 |
| 3,334,950 | 8/1957 | Brownlee | 312/10 |
| 3,485,458 | 12/1969 | Evans | 242/129.72 |
| 3,747,754 | 7/1973 | Nix et al. | 312/197 |
| 3,765,619 | 10/1973 | Stillman | 242/129.5 |
| 3,985,313 | 10/1976 | Klein et al. | 242/25 |
| 4,049,330 | 9/1977 | Schlapp | 312/97.1 |

*Primary Examiner*—Leonard D. Christian

*Attorney, Agent, or Firm*—Christensen, O'Connor, Johnson & Kindness

[57] ABSTRACT

A wire spool holding and positioning apparatus includes a frame assembly having a plurality of spool location which is movable to place a selected spool location into a presentment position in which the spool will be easily accessible to an operator for removal of wire from the spool. The frame is powered and motion of the frame is controlled by a control circuit that includes a selection device enabling the operator to select a desired spool location to be placed in the presentment position. The control circuit moves the frame assembly until a signal is received from a position-monitoring apparatus indicating that the desired spool location is in the presentment position. When such an indication is received, the control circuit halts the motion of the frame. Preferably, the frame comprises a spoked wheel having spool locations at the outer ends of the spokes. The position-monitoring means includes a series of microswitches selectively engaged by trip bars mounted on the spoked wheel in a pattern such that the position of the spoked wheel is related to which of the microswitches is engaged. The selection device is preferably remote from the frame.

9 Claims, 7 Drawing Figures

POWERED WIRE SPOOL HOLDING AND POSITIONING APPARATUS

BACKGROUND OF THE INVENTION

This invention relates to apparatus used in the preparation of wiring harnesses; and in particular, it relates to a wire spool holding and positioning apparatus for maintaining the wire spools in a location easily accessible by personnel making up the wire harnesses.

In the manufacture of aircraft, ships and other large pieces of equipment it is usually necessary to use extensive electrical wiring in order to operate all systems of the equipment. Typically, the wires are bundled together to form wire harnesses prior to the final assembly of the equipment. In that portion of the manufacturing plant in which the wire harnesses are prepared, it is necessary to store various sizes and types of wires on spools adjacent the area of wire harness preparation in order to provide the personnel making the wire harnesses easy and frequent access to the wire spools. Prior art wire spool holding apparatus has comprised a stationary wire spool tree including a plate bolted to the floor and having a vertical post mounted to the plate. Four horizontally-oriented rods are mounted on the vertical post in even vertical distribution. The wire spools are then placed on the rods usually two spools per rod. The tree assembly is placed near the location where the wire harnesses are being prepared. Usually two or three of these wire spool trees are placed in series to provide ample storage room for a number of different wire sizes and types. A disadvantage of the prior art systems is that the spools are at varying levels above the floor. In order to make it easy for the personnel preparing the wire harnesses to reach wires on various levels, it is necessary to run all of the wires from the various spools through a common access point, usually at about waist level, at which the wire harness preparer can pick them up.

If a common access point system is used it means that the wires from the lower level spools will have a steep angle to climb before reaching the access point and any wires coming from upper level wire spools will have to travel along a steep angle downwardly to the common access point. Oftentimes a machine is utilized to cut and mark the wires being prepared for the individual wire harnesses. In such a situation, the wires would be pulled from the cable spools by the cutting and marking machine. If the wires coming to the cutting and marking machines are from spools which are placed so that the angle of the wire as it is fed into the cutting machine is great a vertical force is applied to the pulling apparatus thereby exerting an abnormal wear factor on the bearings associated with the pulling device which bearings are set up to accommodate only horizontal motion and not vertical motion.

In addition to the disadvantage of angularity in reaching the common pickup point, the use of a common pick up point also means that the several wires will be brought together at a single point creating a possibility of confusion on the part of a worker attempting to take hold of a particular wire. Also the possibility exists that wires from different spools will become entangled, thereby making the harness fabricating operation less efficient since time has to be taken to untangle any such wires.

A further problem associated with the standard stationary wire spool tree arrangement is in the loading of new wire spools onto such tree. The typical wire spool, when it is filled with wire, weighs in the neighborhood of forty pounds. Therefore, the upper level wire spools will require someone with sufficient strength to lift a forty-pound spool to the height of the rod upon which the spool must be placed in the wire tree. Only those spools which are in the second row from the bottom are at a convenient level for placement of spools on the tree.

It is therefore an object of the present invention to provide an apparatus for holding and positioning wire spools so that they are easily accessible to personnel preparing wire harnesses.

It is a further object of this invention to provide such a holding and positioning apparatus which can hold a plurality of cable spools simultaneously and position them selectively to provide the wires to personnel at a level substantially even with the input to a wire cutting and marking machine.

It is a another object of this invention to provide an apparatus for holding wire spools onto which the spools can be loaded without the necessity of lifting the wire spools to heights above waist level.

It is an additional object of this invention to provide such a wire spool handling apparatus which takes up a minimum amount of floor space in the manufacturing facilities.

SUMMARY OF THE INVENTION

In accordance with the above-stated objects, an apparatus for holding and positioning a plurality of wire-containing spools includes a frame rotatably mounted on a base. The frame includes a plurality of spool holding locations and motor means are provided for moving the frame so as to selectively position the spool holding locations to a presentment position, for example, adjacent to and at an even vertical level with the wire pulling input of a wire cutting and marking machine. A selector means operable to select the spool holding location that is to be placed in the presentment position are provided. Position monitoring means are mounted on the frame and are associated with a control means so as to track the position of the frame. The control means is responsive to signals produced by the position monitoring means to cease motion of the frame when the desired spool holding location reaches the presentment position.

In a preferred embodiment the position monitoring means comprises a series of trip bars mounted on the frame at each spool holding location. The trip bars are arrayed in binary fashion and are positioned to engage a bank of microswitches mounted on the base. The microswitches are wired to a plurality of relays in such a manner as to remove power from the motor means upon the proper sequence of microswitches being tripped to indicate that the desired wire spool location is in the presentment position.

Preferably, the frame is a spoked wheel, each of the spool holding locations coinciding with the spokes of the wheel. The frame rotates in a vertical plane to bring each of the spool holding locations to the presentment position which is located conveniently to the operator. Also, in the preferred embodiment the control means includes a plurality of pushbutton switches, each of which is operable to select the desired spool holding location to be placed in the presentment position. The spool holding locations and buttons are preferably cooperatively marked with certain indicia to permit the operator to choose a desired spool holding location and its associated pushbutton with ease.

BRIEF DESCRIPTION OF THE DRAWINGS

The invention disclosed herein will be better understood by those of ordinary skill in the art and others upon reading the ensuing specification taken in conjunction with the attached drawings wherein.

DETAILED DESCRIPTION OF THE PREFERRED EMBODIMENT

Figure 1:
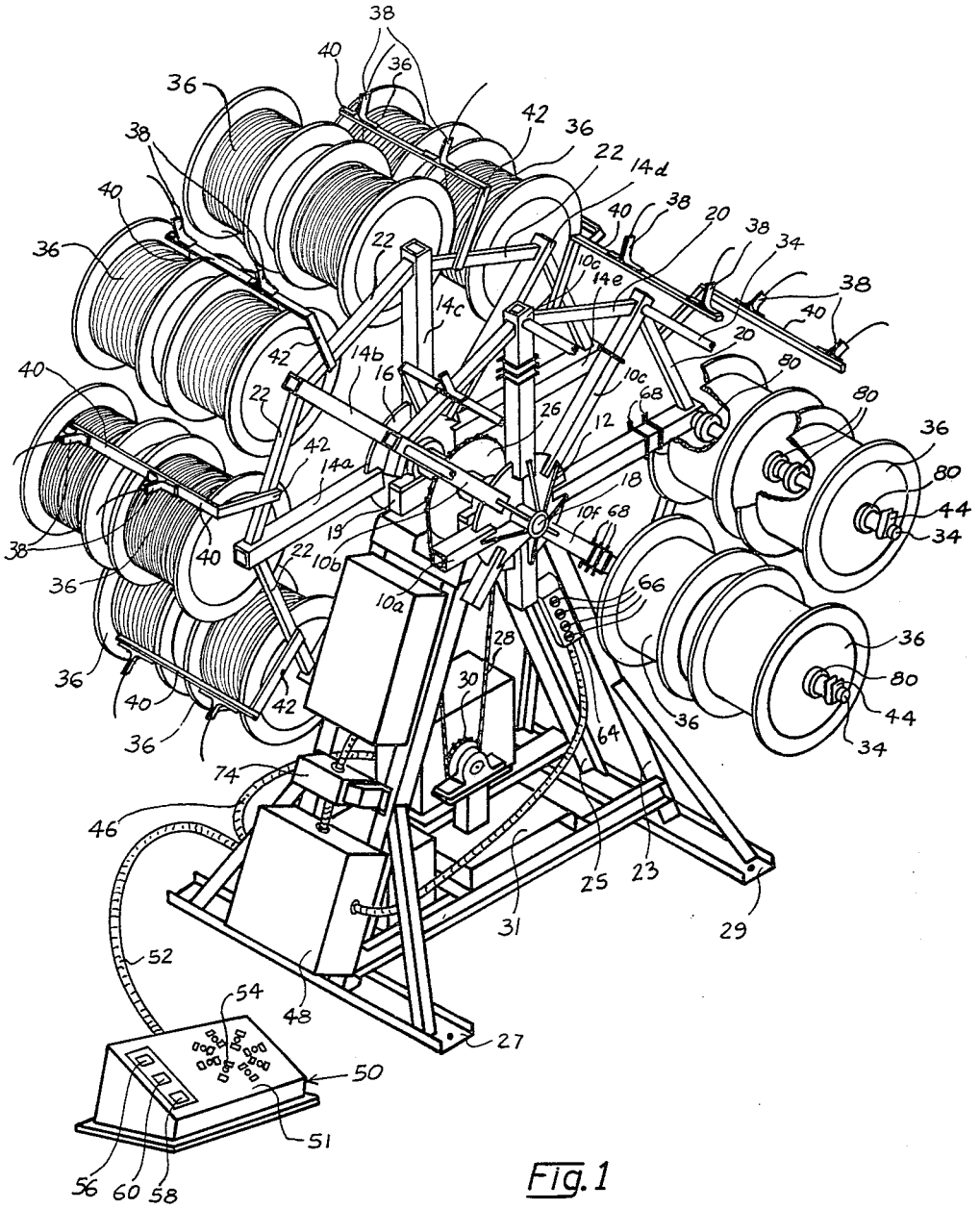
FIG. 1 is an isometric view with portions removed of a wire spool holding and positioning apparatus made in accordance with the principles of the present invention.
Figure 2:
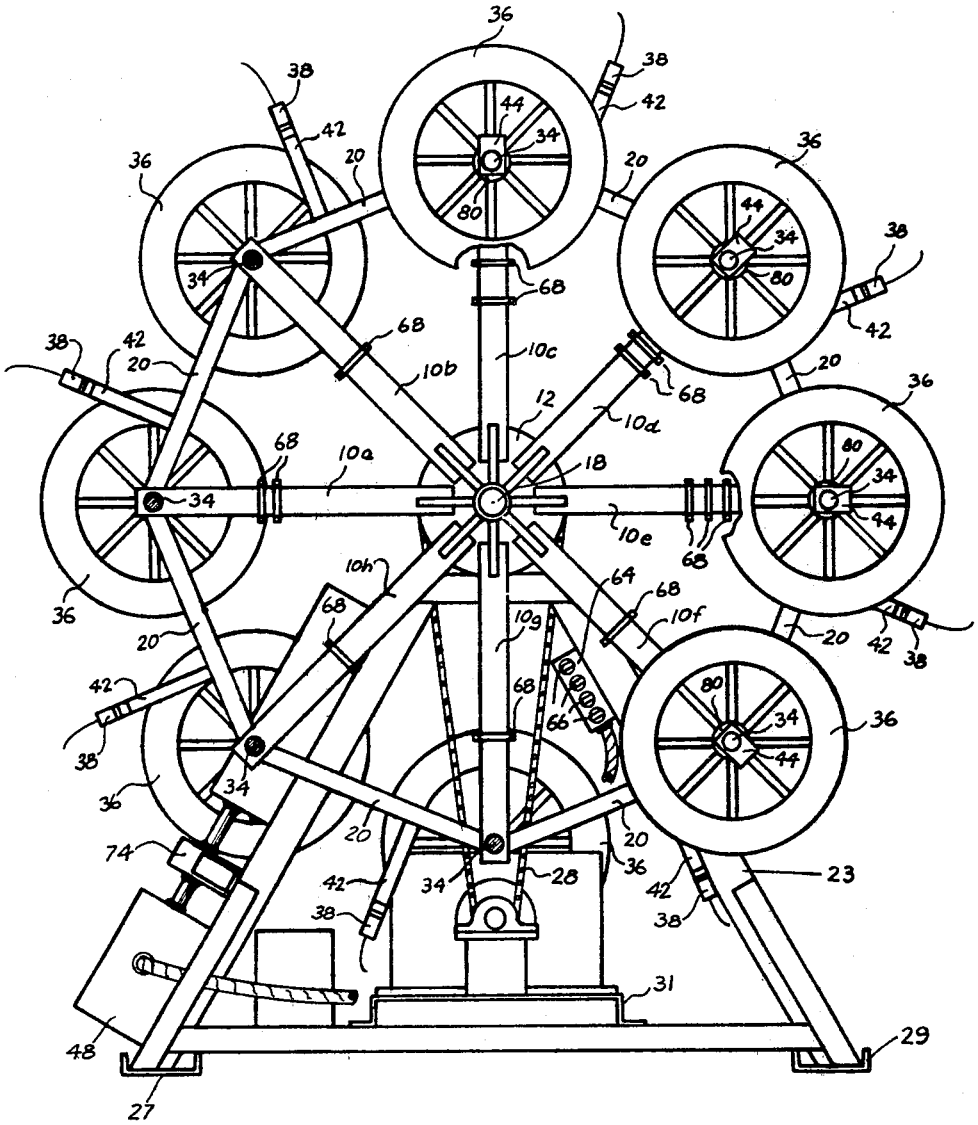
FIG. 2 is a side elevational view in partial section of the wire spool holding and positioning apparatus of FIG. 1.
Figure 3:
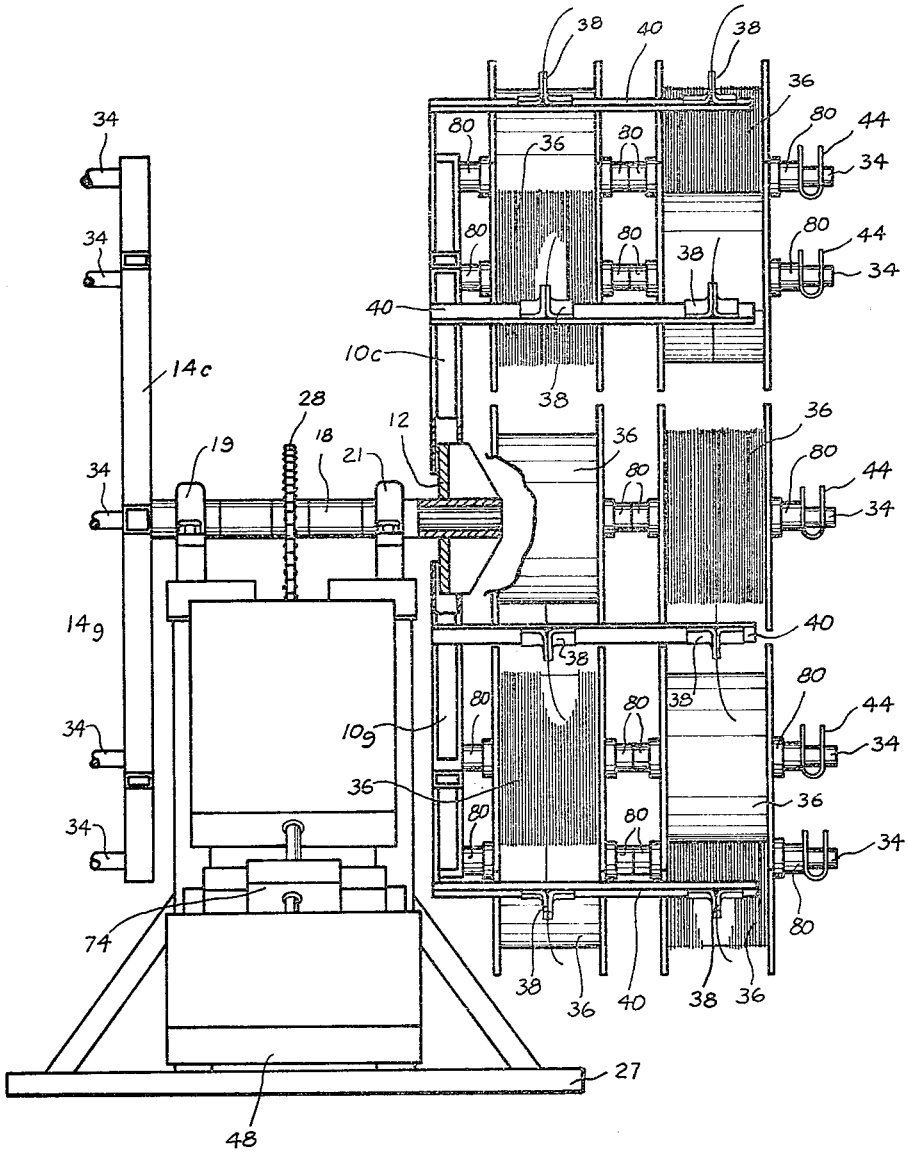
FIG. 3 is a front elevational view showing one side of the wire spool holding and positioning apparatus of FIG. 1.

A preferred embodiment of a wire spool holding and positioning apparatus made in accordance with the principles of the present invention is illustrated in FIGS. 1, 2 and 3. A first spoked wheel is comprised of spokes 10*a* through *h* affixed at first ends thereof in radial arrangement about a hub 12. A second spoked wheel is comprised of spokes 14*a* through *h* radially arranged about a second hub 16 and fixed to the hub at their first ends. The spoked wheels are affixed in parallel relationship to one another on a common axle 18 which is mounted on parallel support yokes 19 and 21 for rotation of the wheels in a substantially vertical plane. The second ends of adjacent spokes 10*a* through *h*, distal to the hub 12, are joined together by suitable structural members 20 to maintain rigidity of the spoked wheel arrangement. An identical set of structural members 22 similarly join the seconds ends of the spokes 14*a* through *h*. Two parallel A-frames 23 and 25, respectively, are mounted on parallel base channel members 27 and 29. Each of the yokes 19 and 21 is mounted at approximately the apex of its respective A-frame 23 or 25 so that the A-frames support the spoked wheel arrangement rotatable in a vertical plane. A first sprocket 26 is rigidly mounted on the axle 18 intermediate the yokes 19 and 21 and is driven by a chain 28 from a drive sprocket 30 mounted on a support platform 31 in the base of the A-frame structure. The drive sprocket 30 in turn is driven by a motor also mounted on the platform 31. Control of the motor is provided by circuitry which will be described below. Preferably the motor is coupled to the drive sprocket 30 through a conventional speed reducer. Also the first sprocket 26 is larger in diameter than the drive sprocket 30 to provide further speed reduction. A desirable revolution rate for the spoked wheels has been found to be approximately 3 r.p.m.

Each of the spokes 10*a* through *h* and 14*a* through *h* have a spool holding rod 34 affixed to the second end thereof. The spool holding rods are orthogonal to the plane of rotation of the spoked wheels. The rods 34 associated with the spokes 10*a* through *h* extend in the opposite direction of the rods affixed to the spokes 14*a* through *h*. The rods 34 receive wire spools 36, each rod being of a length sufficient to accept two spools. The diameter of the rod is such as to allow the wire spools to turn freely upon the rod. In the illustrated embodiment there are eight spokes on each wheel and two wire spools mounted on each rod so that a total of 32 spools can be loaded on the wire spool holding and positioning apparatus. These figures are exemplary only.

In the illustrated embodiment in FIG. 1, the spools associated with the spokes 10*a* and 14*a* are located at a height from the floor equal to height of the input of a wire towing apparatus (not shown). The towing apparatus can be a part of a wire cutting and marking machine (not shown). By rotating the wheels any of the wire spools can be placed in the position occupied by the spools associated with the spokes 10*a* and 14*a*. The desired wire spool can therefore be placed on an even level with the towing apparatus to eliminate substantially all of the vertical forces that were placed on the towing apparatus by the prior art wire spool tree arrangements discussed above. The position at which the spools are most convenient to the towing machine and on an even level with it will be called the presentment position.

Input power to the spool holding and positioning apparatus is fed through cable 46 to an electrical junction box 48 mounted on the A-frame. A control console 50 is connected to the electrical control box 48 by a suitable cable 52. The control console 50 has a control panel 51 having a series of row select pushbutton switches 54*a* through *h*, used by the operator to select a desired spool row for placement into the presentment position. A forward switch 56 and a reverse switch 58 are also located on the control panel and provide an input to a motor controller 70 to determine the direction in which the motor will drive the frame assembly. A stop switch 60 is also provided to stop the motion of the frame assembly.

The respective wire end on the wire wound on each of the spools 36 is held by a wire holding clip 38 which is mounted on a clip mounting member 40. One clip mounting member 40 is associated with each spool holding rod 34 and is substantially parallel to its associated spool holding rod. The members 40 are spaced from the rod 34 a sufficient distance to allow clearance for the wire spool. Each clip mounting member is affixed to a mounting arm 42, the first end of which is affixed to the structural member 22 and the second end of which is affixed to the clip holding member 40. The wire clips 38 are comprised of two planar members composed of a spring material, for example thin sheets of nylon or Teflon butted against one another to form a spring-loaded nip which holds the wire as it comes off the spool for easy access by the operator. The wire spools 36 are kept from slipping off the rods 34 by means of retainer pieces 44 each of which comprises a substantially U-shaped planar member having a hole formed therein, the U-shaped member is slightly spring-biased to a straightened position and therefore maintains some tension against the rod 34 to keep the retainer piece in position upon the rod.

The position of the spoked wheels is monitoring by a position-monitoring means that includes a microswitch assembly 64 mounted on the A-frame 24 and having four microswitches 66 mounted thereon. The microswitches are oriented to make contact with trip bars 68 which are mounted on the spokes 10*a* through *h*. The trip bars 68 are mounted on the spokes in a predetermined pattern so that as the tip bars engage the microswitches the signals from the microswitches indicate spoke position. The trip bars 68 and microswitches 66 and their relation to a control circuit which controls the motion and positioning of the spoked wheel assemblies will be discussed in greater detail below.

Figure 4:
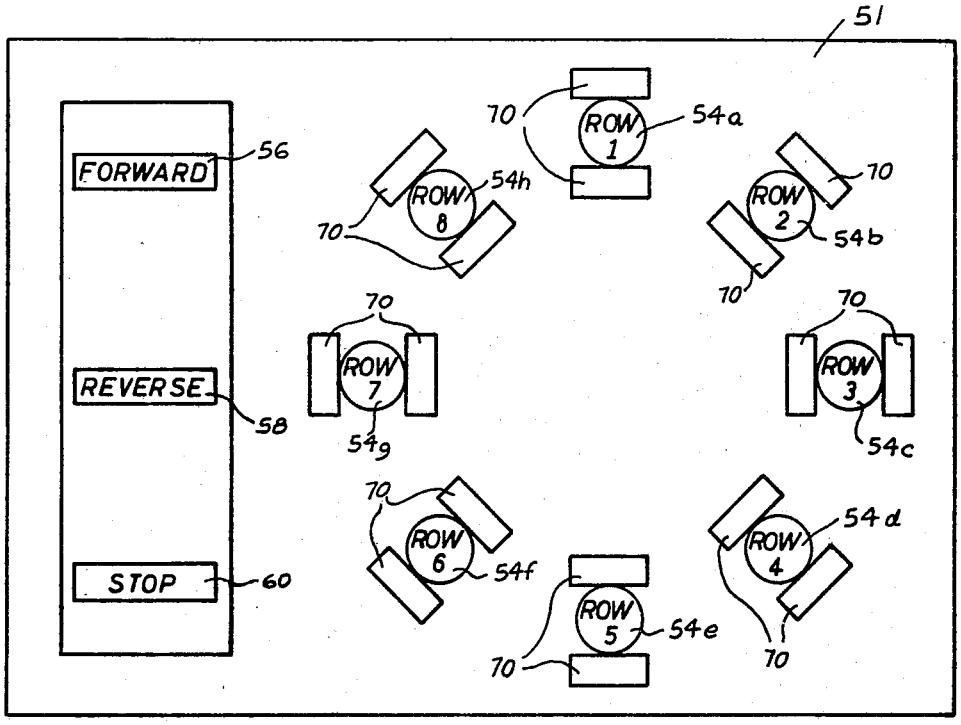
FIG. 4 is a plan view of the control panel associated with the apparatus of FIG. 1.

Referring now to FIG. 4, the control panel 51 is shown in greater detail. Each of the row select pushbuttons 54*a* through *h* is associated with one of the rows of spools on the spoked wheels. Therefore, each pushbutton is associated with four wire spools. Preferably, the row select pushbuttons 54*a* through *h* are color-coded, each being of a different color. The wire clip mounting members 40 are preferably also color-coded with colors corresponding to the row select pushbuttons 54*a* through 54*h* so that the operator can determine which row he desires to have access to by the color without keeping track of row numbers. A series of tags 70 are affixed to the control panel, two tags associated with each pushbutton. In actual operation each of the tags 70 would contain the size and type of the wire on the spools associated with that row so that the operator can determine which row has the wires which he needs. The tags 70 could be magnetic so that they could be easily changed when the size or type of the wire in a particular row was changed. Upon determining which row has the desired wires mounted thereon, the operator notes the color of the button 54*a* and then determines where that particular row is positioned according to the color of the wire clip mounting member 40 associated with that row. Assuming that the desired row is not in the presentment position, the operator then presses either the forward or reverse button on the control panel to cause the spoked wheel assembly to rotate in a vertical plane. Whether the forward or reverse button is pushed is determined by the position of the desired row. The operator can choose the direction of rotation that will bring the desired row to the presentment position in the shortest amount of time. For the illustrated embodiment, the approximate time to move from one row to the next is 3 seconds. The wheel makes one complete revolution in a time of 22 seconds. Therefore, since the wheel can move in either forward or reverse, the maximum time that is necessary to move to any desired row is 11 seconds.

Figure 5:
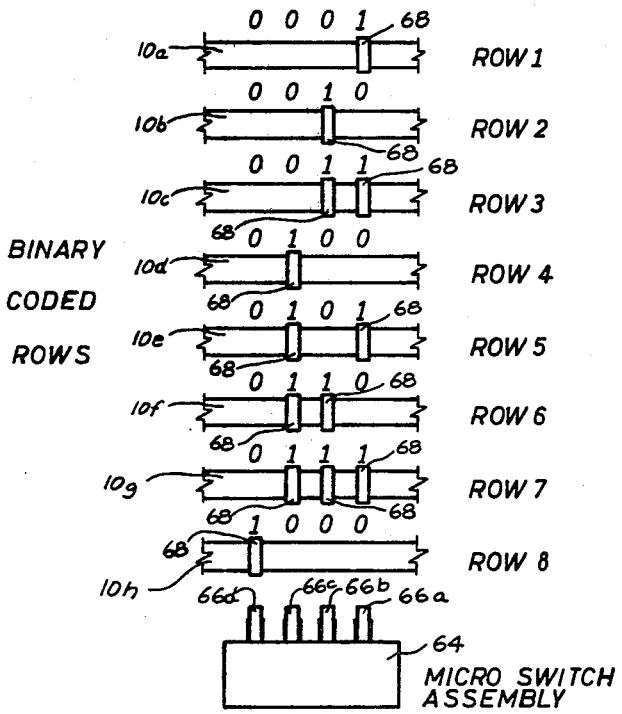
FIG. 5 is a diagram illustrative of a position-monitoring system for use with the wire spool holding and positioning apparatus of FIG. 1.

The motion of the spoked wheel assembly continues until the desired row is placed in the presentment position. When that row has been positioned correctly the apparatus stops automatically. The position of the wheel is monitored by means of the trip bars 68 and microswitches 66. The trip bars are arranged on the spokes 10*a*–10*h* in a binary arrangement, as illustrated in FIG. 5. The spoke designated as row 1 contains one trip bar in a position to contact with the microswitch 66*a* as the spoke associated with row 1 passes the microswitch assembly 64. Similarly, the spoke associated with row 2 has a single trip bar 68 located in a position to contact a second microswitch 66*b*. The sequence of trip bars continues to the binary equivalent of decimal 8. A comparison circuit is provided which receives a signal indicating which of the row select pushbutton 54*a* through *h* is depressed. Signals from the microswitches 66*a* through *d* are also received by the comparison circuitry in response to depression of the microswitches by the trip bars 68 as the spokes pass by the microswitch assembly 64. When the information from the microswitch assembly 64 matches the information received from the depressed pushbutton, the power to the motor 32 is shut off by the control circuit, thereby stopping the motion of the spoked wheel arrangement with the desired row at the presentment position.

Figure 6A:
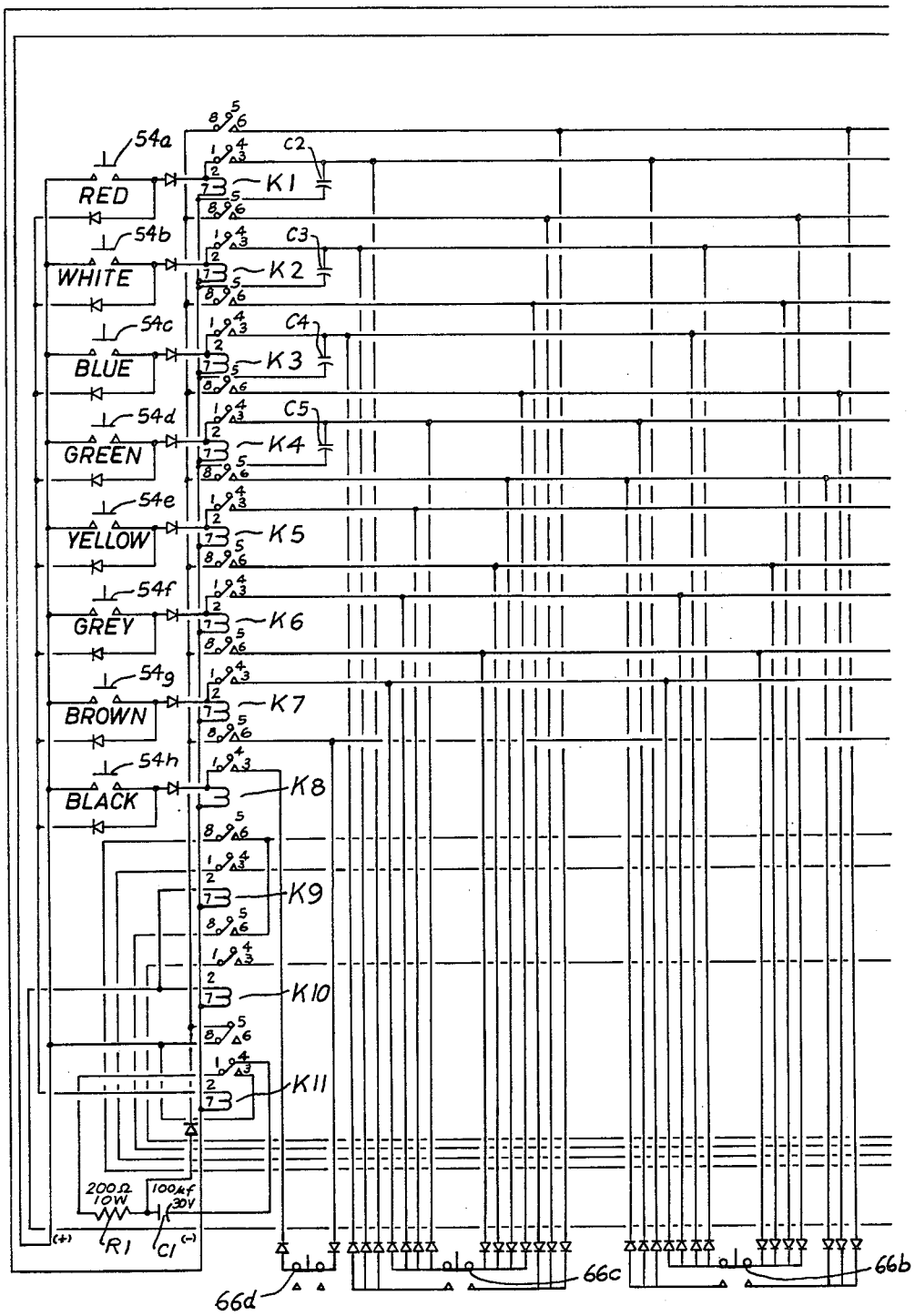
FIGS. 6A and 6B taken together form a schematic diagram of an electrical control and position-monitoring system for use with the apparatus of FIG. 1.
Figure 6B:
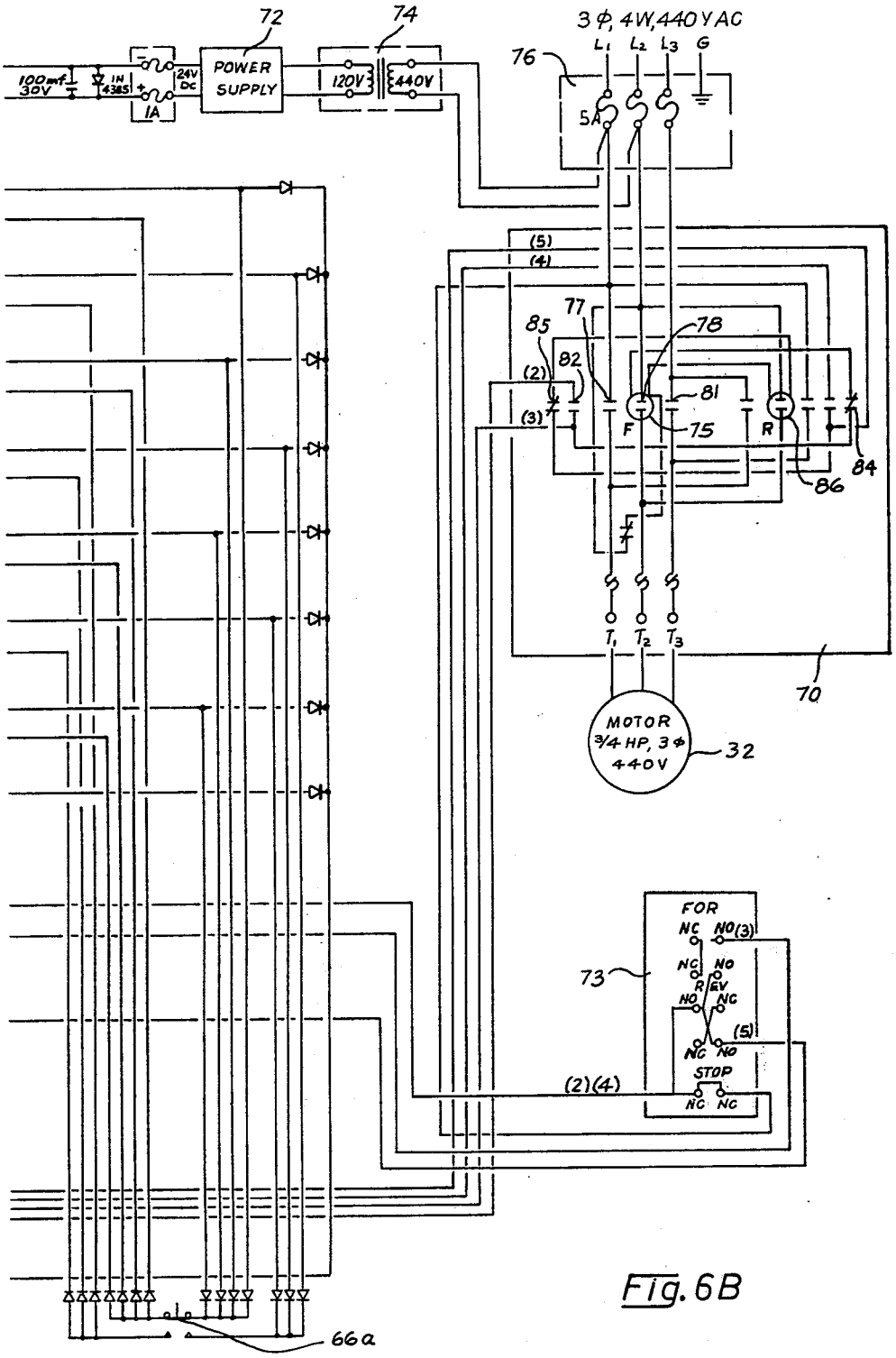

A suitable control circuit for the illustrated wire spool holding and positioning apparatus is shown in FIGS. 6A and 6B. The pushbuttons 54*a* through *h* are shown with color designations. The same colors could be marked on the appropriate wire clip mounting members 40 as was earlier described. Pressing the desired one of pushbuttons 54*a* through *h* sets the appropriate relays K1 through K11 and upon depression of the forward or reverse switch 56 or 58 power will be provided to the motor 32 to drive the spoked wheel arrangement. As the spoked wheel arrangement rotates the normally closed microswitches 66*a* through 66*d* will be opened by the trip bars 68 as they engage the microswitches. When the proper microswitches are opened the relays which have been set by depression of a particular row selection pushbutton will be deenergized thus, the signal to the motor controller 70 will be cut off and the motor 32 will stop with the selected row in the presentment position.

Voltage to the control circuitry is supplied by a power supply 72 which receives input power from a stepdown transformer 74 connected to the line voltage through a fuse box 76. The power supply 72 develops a 24 volt DC signal which is utilized to control relays K1 through K11. The motor 32 can be any suitable motor and in the illustrated embodiment is a $\frac{3}{4}$ horsepower, three-phase 440-volt AC motor. While the control circuitry shown in FIGS. 6A and 6B utilizes discrete relays to control the operation of the motor 32, it would also be possible to use digitally encoded logic circuitry or other suitable circuitry to control the operation of the motor 32. Preferably, the switches 56, 58 and 60 are wired so that it is impossible to switch the spoked wheel arrangement from moving in the forward direction to moving in the reverse direction without first stopping the unit by depression of the stop switch 60. However, it is possible to change the selected row while the motor is running.

As an example of the operation of the control circuitry shown in FIGS. 6A and 6B assume that row select pushbutton 54*h* associated with row 8 is depressed. The relay K8 is energized thereby closing the normally open contacts of the relay. Pushbutton 54*h* also routes a positive voltage to the coil of relay K11 energizing that relay and closing its normally open contacts. The contacts 3 and 6 of relay K8 are connected through normally closed microswitch 66*d* and the energizing voltage on the coil of relay K8 is maintained through the contacts 1 and 3 of K11 which are now closed. After the momentary contact pushbutton 54*h* returns to its open position and the relay K11 deenergizes the relay K8 remains energized through the decay of the R-C network formed by R1 and C1. The decay time of the R-C network is longer than the contact opening time of the relay K11, therefore K8 is kept energized long enough for the normally closed contacts of K11 to return to their normally closed state. When K11 is deenergized, the positive voltage necessary to maintain K8 in an energized state is supplied to K8 through the contacts 5 and 8 of relay K11 which are in their normally closed state.

The current path completed when K8 is energized also energizes relays K9 and K10 through the microswitch 66*d*. The normally open contacts of K9 and K10 then close and make connection to the motor controller 70 and motor controller pushbutton station 73. The motor controller 70 can be any conventional reversing motor starter and in the illustrated embodiment is an A-C reversing magnetic starter such as that commercially available from Cutler-Hammer under the designation A50 AGOC. Similarly, the pushbutton station 73 is a conventional item such as a Cutler Hammer 10-250 H5300 unit. Some wiring modification was made to the pushbutton station 73 to achieve the circuit illustrated.

After depressing the desired row select pushbutton, the motor will not be started until either the forward switch 56 or the reverse switch 58 on the pushbutton station 73 is depressed. If the forward switch is depressed, a current path will be formed through the switch and through the now closed contacts of K9 and the normally closed contacts 84 of the motor controller 70 to energize the forward coil 75 of the motor controller 70. The normally open contacts 77, 78, 81 and 82 of the forward side of the controller will close and normally closed contacts 85 will be open. Power will be supplied to the motor 32 and the frame will be moved in the forward direction.

The motor will continue to run until the trip bar 68*d* engages the microswitch 66*d* and forces it to its open position. When microswitch 66*d* opens, relay K8 will deenergize, thereby causing relays K9 and K10 to deenergize. The circuit energizing the forward coil 75 of the motor controller will be opened by the deenergization of K9 and K10 and the motor controller will return to its deenergized state thereby removing power from the motor. The motor can also be stopped by depressing the stop switch 60 thereby opening its normally closed contacts and breaking the circuit to the motor controller.

While the motor is running, it is possible to change row selection simply by depressing another of the row select pushbuttons. For example, if it is desired to change from row 8 (black) to row 1 (red), the pushbutton 54*a* is depressed. Relay K1 is therefore energized and also relay K11. Since the relay K8 has been energized through the path formed by the normally closed contacts 5 and 8 of relay K11 energization of K11 will deenergize K8. However, since the deenergizing of K8 occurs simultaneously with the energizing of K1, K9 and K10 will remain energized through K1 so that the motor will continue to run. The motor will continue to run until K1 is deenergized by the opening of the microswitch 66*a* by trip bar 68*a*. The row selection circuitry for the remaining rows operates in a similar fashion with the microswitches being interconnected to achieve the desired binary coding.

The binary coding of the trip bars 68 and microswitches 66*a–d* results in certain of the bars and microswitches being common to more than one row. The commonality of switches can result in the wheel erroneously stopping at one of the rows having the common microswitch associated with it instead of continuing to the desired and selected row. For example, microswitch 66*a* will be engaged by a trip bar 68 when the spokes associated with rows 1, 3, 5 or 7 pass by it. If the spools associated with row 8 are in the presentment position and it is desired to move the frame to position row 3 in the presentment position, it is quickest to move the frame in reverse. The trip bars designating when row 1 is in the presentment position will therefore pass the microswitch assembly 68 prior to the trip bars associated with row 3. As the row 1 trip bar engages the microswitch 66*a* which is associated with both rows 1 and 3 there is a possibility that the circuit will break and the motor will stop even though the microswitch 66*b* which is also associated with row 3 is not engaged. A capacitor C2 is connected across the coil of relay K1 to delay the opening of K1 long enough for the wheel to move past the point of engagement of the trip bar with the microswitch 66*a*. Once microswitch 66*a* returns to its normally closed condition, there is no possibility of K1 opening and motor continues to run until row 3 is reached. When row 3 is reached, both microswitches 66*a* and 66*b* are engaged and opened and a positive stop indication is received that opens the relays and stops the motor even with the delay introduced by C2. Similar capacitors C3, C4 and C5 are connected respectively across the coils of K2, K3 and K4 to eliminate false stops caused by the commonality of microswitches 66*b* and 66*c*.

While the motor is running in the forward direction, it is not possible to reverse its direction without first stopping the motor and deenergizing the motor controller forward relay coil 75. The reason for this is that the path to energize the reverse coil 86 is completed through the normally closed contacts 85 of the controller 70. However, with the controller forward coil 75 energized and the motor running forward, the contacts 85 are open. Therefore, the circuit path to the reverse relay coil 86 cannot be completed until the forward coil 75 is deenergized and the contacts 85 return to their normally closed state. Of course deenergizing the forward coil 75 will stop the motor. The circuitry for operating the motor in reverse is similar to the forward circuitry except that the circuit path completed upon depression of the reverse switch 58 is formed through the contacts of relay K10 rather than K9 and the reverse coil 86 is energized rather than the forward coil 75.

In order to prevent binding of the spools as they spin when the wire is pulled therefrom, it is desirable to have some sort of spacer 64 mounted on the spool holding rods 34 intermediate the spokes 10*a* through 14*a* through *h* and the spools and also between adjacent spools on the same rod. If the wire is being pulled from the spool by a modern wire cutting and marking machine, towing speeds of up to 300 feet per minute can be achieved. At these speeds the wire spools are spinning rapidly on the rods 34. When the towing stops, the spools will tend to free wheel and excess wire can be unwound from the spool and become tangled in the mechanism. It may be desirable to provide a friction braking mechanism associated with the spool, possibly as part of the spacers 64 to stop the spin of the spool so that it does not freewheel.

In summary therefore, a wire spool holding and positioning apparatus is provided which holds a plurality of wire spools and includes a frame which is movable to position the spools in a presentment position easily accessible by an operator for removal of wires from the spools mounted on the apparatus. A control circuit is provided to control motion of the wire spool holding and positioning apparatus which enables an operator to select a desired set of spools for placement in the presentment position. The apparatus includes a position monitoring means which monitors the position of the spool rows and cooperates with the control circuitry to halt the motion of the frame when the desired row of spools has reached the presentment position. While a preferred embodiment of the wire spool holding and positioning apparatus of the present invention has been described and illustrated, it will be apparent to those of ordinary skill in the art that several changes can be made in the illustrated embodiment while remaining within the scope of the present invention. For example, although a particular circuit using discrete relays has been described, the control circuitry can also be a digital logic circuit. Also, while the illustrated embodiment has eight spokes and carries 32 spools, those numbers are exemplary only and other numbers of spokes and spool capacities can be achieved by altering the geometric design of the apparatus. The invention should be defined therefore solely by reference to the appended claims.

The embodiments of the invention in which an exclusive property or privilege is claimed are defined as follows:

1. Apparatus for selectively positioning spools containing wire so as to place said wire in a presentment position for removal of said wire from said spools comprising:

base means;

rack means rotatably mounted on said base means;

a plurality of spool receiving means associated with said rack means for receiving said spools;

position-monitoring means associated with said rack means for producing a first signal indicative of rack position;

position selection means operable to produce a second signal indicative of a desired rack position;

comparison means for receiving said first signal and said second signal, said comparison means producing a third signal upon said rack position coinciding with said desired position;

motor means associated with said rack and said position selection means to drive said rack; and motor controller means associated with said motor means, said motor controller means being responsive to said third signal to stop the motion of said rack upon reception of said third signal.

2. The apparatus of claim 1 wherein said motor means is selectively operable through said motor controller means to move said rack means in a first direction or a second direction and wherein further said motor controller means is constructed and arranged such that the motor can be operated to drive the rack in either the first or second direction only from a stopped condition of the rack means.

3. The apparatus of claim 1 or 2 wherein said position selection means is constructed and arranged to be operable while said rack is moving to change the desired rack position.

4. The apparatus of claim 1 wherein said base means and said rack means are constructed and arranged such that said rack means rotates in a substantially vertical plane.

5. The apparatus of claim 1 wherein said rack means includes:

a hub member rotatably mounted on said base means;

a plurality of spoke members radially arranged about said hub member, said spool-receiving means being rigidly affixed to said spoke members and oriented substantially orthogonally to the plane of rotation of said rack means.

6. The apparatus of claim 5 wherein said motor means is selectively operable through said motor controller means to rotate said hub members in a clockwise or counterclockwise direction.

7. The apparatus of claim 5 wherein said position-monitoring means includes:

a plurality of coding members mounted on said spoke members and arranged in binary fashion;

a plurality of microswitches mounted on said base means, said coding members and said microswitches cooperating such that as said rack means rotates said coding members engage said microswitches to produce said rack position indicative signal in a binary fashion.

8. The apparatus of claim 1, 2 or 5 wherein said position selection means is located remotely from said rack means.

9. The apparatus of claim 7 wherein said motor means comprises an electric motor and wherein further said position selection means includes:

a switch panel;

a plurality of normally open row switches selectively closeable to select the desired rack position;

a plurality of relays connected to said row switches, said relays selectively energized in patterns determined by closing of selected ones of said switches to route electric power to said motor controller means, said relays being also connected to said microswitches, said relays being deenergized upon engagement of said coding members with said microswitches when said rack means reaches said desired rack position.

* * * * *